US010125459B2

(12) United States Patent
Hessels

(10) Patent No.: US 10,125,459 B2
(45) Date of Patent: Nov. 13, 2018

(54) TELESCOPIC ACCESS BRIDGE, UNIT PROVIDED THEREWITH, AND METHOD THERE FOR

(71) Applicant: U-SEA BEHEER B.V., Drachten (NL)

(72) Inventor: Hendrik Hessels, Drachten (NL)

(73) Assignee: U-SEA BEHEER B.V., Drachten (NL)

( * ) Notice: Subject to any disclaimer, the term of this patent is extended or adjusted under 35 U.S.C. 154(b) by 0 days.

(21) Appl. No.: 15/569,949

(22) PCT Filed: Apr. 28, 2016

(86) PCT No.: PCT/NL2016/050301

§ 371 (c)(1),
(2) Date: Oct. 27, 2017

(87) PCT Pub. No.: WO2016/175656

PCT Pub. Date: Nov. 3, 2016

(65) Prior Publication Data

US 2018/0155885 A1 Jun. 7, 2018

(30) Foreign Application Priority Data

Apr. 28, 2015 (NL) ..... 2014725
May 13, 2015 (NL) ..... 2014803
Sep. 15, 2015 (NL) ..... 2015438

(51) Int. Cl.
*E01D 15/04* (2006.01)
*E01D 15/12* (2006.01)
(Continued)

(52) U.S. Cl.
CPC ..... *E01D 15/124* (2013.01); *B63B 27/14* (2013.01); *E01D 15/005* (2013.01); *E01D 15/02* (2013.01);
(Continued)

(58) Field of Classification Search
CPC ..... E01D 15/005; E01D 15/04; E01D 15/124; E01D 15/127; E01D 15/02; E01D 18/00;
(Continued)

(56) References Cited

U.S. PATENT DOCUMENTS 4,421,051 A 12/1983 Hemmett
7,950,095 B2 * 5/2011 Honeycutt ..... B21D 5/00 14/69.5
(Continued)

FOREIGN PATENT DOCUMENTS

FR 2869869 A1 11/2005
NL 7700373 A 8/1977
(Continued)

OTHER PUBLICATIONS

International Search Report and Written Opinion dated Sep. 20, 2016 for PCT/NL2016/050301.

*Primary Examiner* — Raymond W Addie

(57) ABSTRACT

A telescopic access bridge includes a unit provided therewith, and a method therefor. The telescopic access bridge comprises a base unit, an elevating unit having a first end with a first hinged connection to the base unit and a second end, and a bridge comprising a main bridge part and a telescopic bridge part. The bridge has one end with a second hinged connection to the second end of the elevating unit.

15 Claims, 8 Drawing Sheets

(51) Int. Cl.

| | |
|---|---|
| ***E01D 15/127*** | (2006.01) |
| ***E01D 15/00*** | (2006.01) |
| ***B63B 27/14*** | (2006.01) |
| ***E01D 15/02*** | (2006.01) |
| ***E01D 15/24*** | (2006.01) |
| *E01D 18/00* | (2006.01) |
| *E01D 19/04* | (2006.01) |

(52) U.S. Cl.
CPC ..... *E01D 15/04* (2013.01); *E01D 15/127* (2013.01); *E01D 15/24* (2013.01); *B63B 2027/141* (2013.01); *E01D 18/00* (2013.01); *E01D 19/04* (2013.01)

(58) Field of Classification Search
CPC ... E01D 19/04; B63B 2027/141; B63B 27/14; B63B 18/00; B63B 19/04
USPC ..... 14/27, 28, 69.5, 2.4; 114/362
See application file for complete search history.

(56) References Cited

U.S. PATENT DOCUMENTS

| | | | | |
|---|---|---|---|---|
| 8,006,337 | B2 * | 8/2011 | Birmingham | B63B 27/143 14/71.1 |
| 8,813,912 | B2 * | 8/2014 | Bennett | B66F 11/04 182/113 |
| 2005/0160962 | A1 | 7/2005 | Wright | |
| 2009/0038088 | A1 * | 2/2009 | Adler | E01D 15/14 14/2.6 |
| 2012/0137450 | A1 * | 6/2012 | Asbjorn | E01D 15/20 14/27 |

FOREIGN PATENT DOCUMENTS

| | | | |
|---|---|---|---|
| WO | 87/02723 | A1 | 5/1987 |
| WO | 2013/174886 | A1 | 11/2013 |
| WO | 2015-057062 | A1 | 4/2015 |

* cited by examiner

TELESCOPIC ACCESS BRIDGE, UNIT PROVIDED THEREWITH, AND METHOD THERE FOR

The present invention relates to a telescopic access bridge or gangway configured for providing access and egress to and from a unit, such as a work vessel, service and maintenance vessel, unit or vehicle, to or from a further unit, such as offshore structures or wind turbine foundations.

Conventional marine access bridges require constructions that need to be maneuvered between a use position and a storage position. Considering the varying (marine) conditions and the substantial forces acting on the bridge a robust design is required. This requires a demand on the available space in a storage position that reduces freight volume, for example.

The objective of the present invention is to obviate or reduce the aforementioned problems and to provide easy and safe access.

The objective is achieved with the foldable marine access bridge according to the invention, the bridge comprising:

a base unit;

an elevating unit having a first end with a first hinged connection to the base unit and a second end;

a bridge comprising a main bridge part and a telescopic bridge part, the bridge having one end with a second hinged connection to the second end of the elevating unit, wherein the second hinged connection is configured to enable a horizontal side-by-side orientation or top-down orientation of the elevating unit and the bridge in a storage position of the telescopic access bridge.

By providing a telescopic access bridge, including so-called gangways, persons are enabled to transfer between a unit provided with a bridge and a further unit including a fixed platform, such as an oil platform, dock, vessel, wind turbine etc. The unit is part of a vessel or ship, for example. The telescopic parts enable adjustment of the distance between the base unit, and the landing zone of the further, receiving, unit. The first connection preferably comprises a height adjustment element, preferably a hydraulic cylinder, to enable height adjustment.

According to the invention the configuration of the elevating unit and the bridge is such that both parts can be stored in a side-by-side or top-down orientation/configuration in a storage position of the telescopic access bridge with the elevating unit and the bridge extending substantially parallel to each other in a horizontal or vertical plane. This significantly reduces the required space for the telescopic access bridge when not in use.

In a presently preferred embodiment of the invention the both parts can be stored in a side-by-side orientation/configuration. This allows that both parts are stored adjacently in a substantially horizontal plane or level.

In a preferred embodiment according to the invention the first and second hinged connections are configured to enable storing the access bridge in a folded position.

The folding of the at least two parts of the access bridge, i.e. the bridge and the elevating unit, is achieved with the hinged connections. This achieves a compact construction requiring a significantly reduced storage volume. This provides an access bridge that is effective in use and can be stored efficiently. For example, the access bridge is dimensioned to enable storing in and/or or as a 20 or 40 ft container, preferably a high cube container, for easy transport by road, rail and/or sea with low freight costs.

In a preferred embodiment according to the invention the unit comprises a slewing mechanism configured for rotating the bridge relative to the elevating unit.

Providing a slewing mechanism enables rotation of the bridge around a substantial vertical axis relative to the elevating unit. This improves the freedom to operate the access bridge. The slewing mechanism is capable of moving the bridge from a storing position to the landing zone. Preferably, the slewing mechanism is part of the second connection. Preferably, the slewing mechanism enables a rotation of at least 180°, more preferably at least 240°. Optionally the slewing mechanism enables a rotation of 360° endless turn. In a presently preferred embodiment the slewing mechanism is suitable for pedestal mounting and tilting frame mounting. This provides additional flexibility to the telescopic access bridge according to the present invention.

In a preferred embodiment according to the invention the telescopic bridge part comprises a bridge tip configured for connecting to another unit in a position of use.

Providing a bridge tip enables a correct and stable position of the bridge to the other unit and enables a flexible setup allowing for multiple landing zone configurations. This enables easy access and regress between a unit provided with the telescopic access bridge according to the present invention and a further unit, such as a work vessel, service and maintenance vessel, unit or vehicle, and other structures such as offshore structures and wind turbine foundations.

Preferably, the telescopic bridge part further comprising an inflatable bridge tip. The inflatable bridge tip enables flexible contact with a landing zone and compensates misalignments and small movements. The inflatable bridge tip may act as bumper element. Other tip executions are also possible due to the preferred modular design of the bridge according to the present invention.

In a preferred embodiment according to the invention wherein the access bridge further comprising an intermediate platform connecting the elevating unit and the bridge.

Providing an intermediate platform further improves the practical application of the access bridge.

In a preferred embodiment according to the invention there is provided a lifting mechanism configured for maintaining the intermediate platform and the base unit substantially level. The mechanism comprises a cylinder for raising and/or lowering the elevating unit comprising the stairs. Preferably, the mechanism comprises at least two cylinders. This provides additional stability to the system and further provides an additional safety measure in case of failure of one of the cylinders.

Alternatively, or in addition, the access bridge comprises one or more beams configured for maintaining the intermediate platform substantially level. Preferably, the beams are provided parallel to improve the stability of the access bridge, and extend substantially parallel to the elevating unit.

In a presently preferred embodiment the intermediate platform can be maintained in a substantially horizontal direction. In this preferred embodiment also the bridge is maintained in a substantially horizontal direction. This improves safe transfer across the bridge.

In a preferred embodiment according to the invention the access bridge further comprises a luffing mechanism.

Preferably, the luffing system comprises a set of cylinders for stability and a set to enable dynamic movement, while limiting the required power input. Providing a luffing mechanism enables rotation of the bridge around a substantial horizontal axis to adjust to the height of the further unit. The luffing mechanism is capable of compensating the heave of the vessel and adjustment to the height from base to landing zone of the further unit. Preferably, the luffing mechanism is part of the second connection. More preferably, the luffing and slewing mechanisms are integrated with the second connection.

In a preferred embodiment according to the invention the elevating unit comprises a stair with a number of steps and further comprises a compensating mechanism configured for adjusting the angle of the steps with the angle of the stairs, preferably mechanically.

Having a compensating mechanism to adjust the orientation of the steps in response to the angle of the elevating unit, i.e. the stairs relative to the ground surface of the bridge that is preferably defined by the base unit/ship's deck, and that preferably can be manipulated with the height adjustment element, such as one or more hydraulic cylinders provides additional safety when using the access bridge.

In a preferred embodiment according to the invention the access bridge further comprises a compensating controller configured for active and/or passive compensation.

Providing compensation with a controller enables compensation of the heave, for example. This increases the operation window for the access bridge according to the invention.

More specifically, the controller in this preferred embodiment is configured for controlling compensation movement. This enables an effective control of disturbances caused by waves. For example, wave disturbances when loading and/or unloading a vessel or ship is caused by wave motion involving a number of wave variables including heading, frequency and height. The disturbances act on the bridge and on the vessel provided with such bridge. For example, waves influence movement of the vessel including roll, pitch and yaw rotational movement and surge, sway and heave translational movements. The compensation controller automatically determines the correction actions that are required for the individual drives or compensators to provide disturbance compensation. This enlarges the window of safe operation with the bridge according to one or more of the preferred embodiments of the present invention.

In a presently preferred embodiment the compensation controller is provided with information about the position of the bridge, slewing angle and/or length of telescopic bridge such that this information can be taken into account when determining the required compensation control actions. The bridge in preferred embodiment of the invention is capable to operate in a safe mode under a wider range of weather conditions involving wave disturbances thereby reducing waiting times. This renders the transfer operation more cost effective. Also, the bridge prevents unsafe operations thereby reducing the number of injuries and accidents when working with the crane.

In an active mode of the compensation controller preferably the luffing, slewing and telescopic movements can be compensated. Therefore, the compensation is position controlled. This is specifically relevant when the free end of the bridge, i.e. bridge tip, is not in contact with a landing platform or other unit. In a passive mode of the compensation controller compensations are performed in response to pressure/forces. Therefore, the compensation is force controlled. This is specifically relevant when the bridge tip rests on a landing platform or other unit.

In one of the illustrated embodiments of the invention preferably two or more (compensation) cylinders are provided on opposite sides of the compensation joint and, therefore, opposite sides of the bridge. This makes an accurate compensation movement possible, enabling the use of relatively small actuators and minimal power requirements. It will be understood that the number and configuration of the compensation cylinders can be designed appropriately to provide a sufficient compensation and may involve the use of a different number of cylinders, for example 4 or 6 cylinders. The actual design may depend on the required forces that are expected for the compensation, for example.

In presently preferred embodiments the drives of the crane comprise hydraulic cylinders or other hydraulic elements. It will be understood that other drives could also be implied including electrical and pneumatic cylinders/drives.

Preferably, the compensation controller comprises an input for receiving information about measured and/or predicted disturbances. Providing the compensation controller with information about the disturbances that are measured and/or predicted enables the compensation controller to determine the optimal corrective action to provide a disturbance compensation for the (marine) bridge. For example, disturbances can be measured by the motion reference unit (MRU). It will be understood that also other systems can be used to provide disturbance information to the compensation controller. Furthermore, the compensation controller preferably receives information about the effective length of the bridge. This enables the compensation controller to take the varying dynamics of the bridge into account when determining the required compensation control actions and movements.

In a preferred embodiment according to the invention the unit is part of a ship, vessel or vehicle. Especially providing the base unit as part of the ship, vessel or vehicle provides an effective system.

Integrating the access bridge with a container, room or space on or at a ship, vessel or vehicle provides a modular system that can be easily installed and/or removed when necessary. This provides optimal flexibility to the access bridge according to the present invention.

The invention further relates to a vessel, ship or vehicle provided with the aforementioned telescopic access bridge.

The vessel or ship or vehicle provides the same effects and advantages as described for the bridge.

The invention further also relates to a method for providing access to another unit, the method comprising the steps of:

providing a foldable telescopic access bridge as described earlier; and positioning the bridge.

The method provides the same effects and advantages as described for the bridge, vessel, ship or vehicle.

Preferably, the method comprises the step of storing the telescopic access bridge. The method achieves an effective storage of the access bridge in a storage position, for example in a container. In a presently preferred embodiment the elevating unit and bridge are stored side-by-side, or in other words in a parallel position, preferably within dimensions that correspond with a 40 ft container. This enables transport of the telescopic access bridge on a trailer and/or in a container.

Preferably, the method comprises the step of storing the access bridge in a direction with a substantially vertical component. This significantly reduces the required storage volume.

Preferably, the method further comprises the step of actively and/or passively compensating movement of the base unit. Compensation of movement enlarges the window of operational conditions under which the bridge can be used.

Further advantages, features and details of the invention are elucidated on basis of preferred embodiments thereof, wherein reference is made to the accompanying drawings wherein.

Figure 7A:
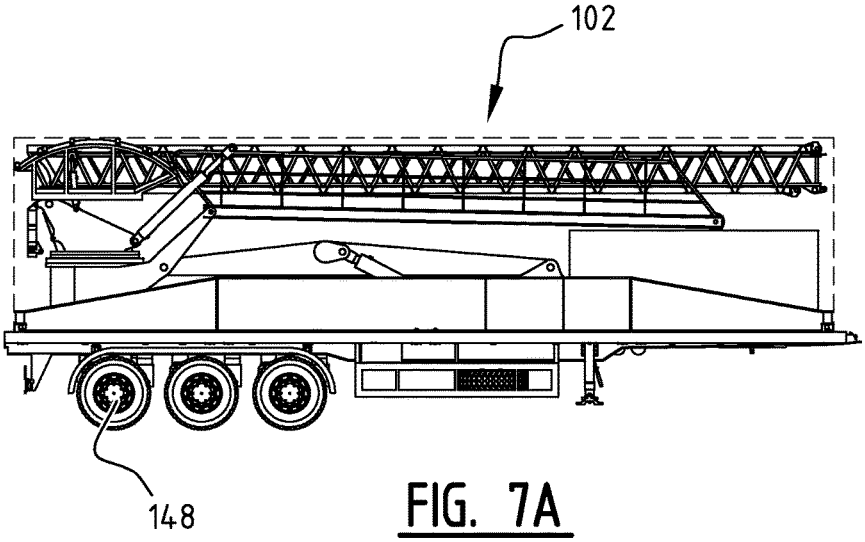
Figure 7B:
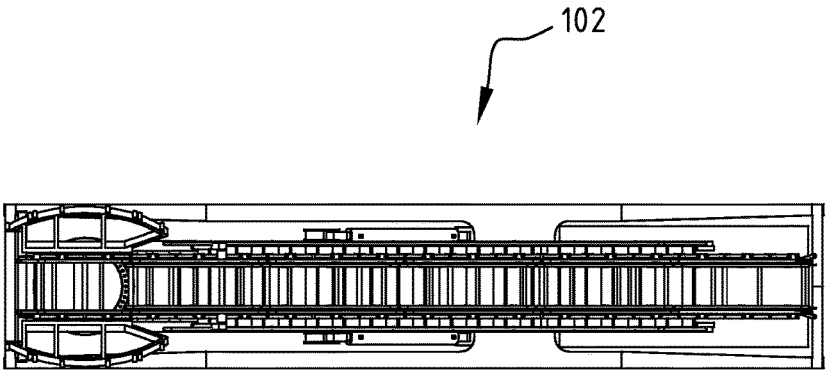
Figure 8:
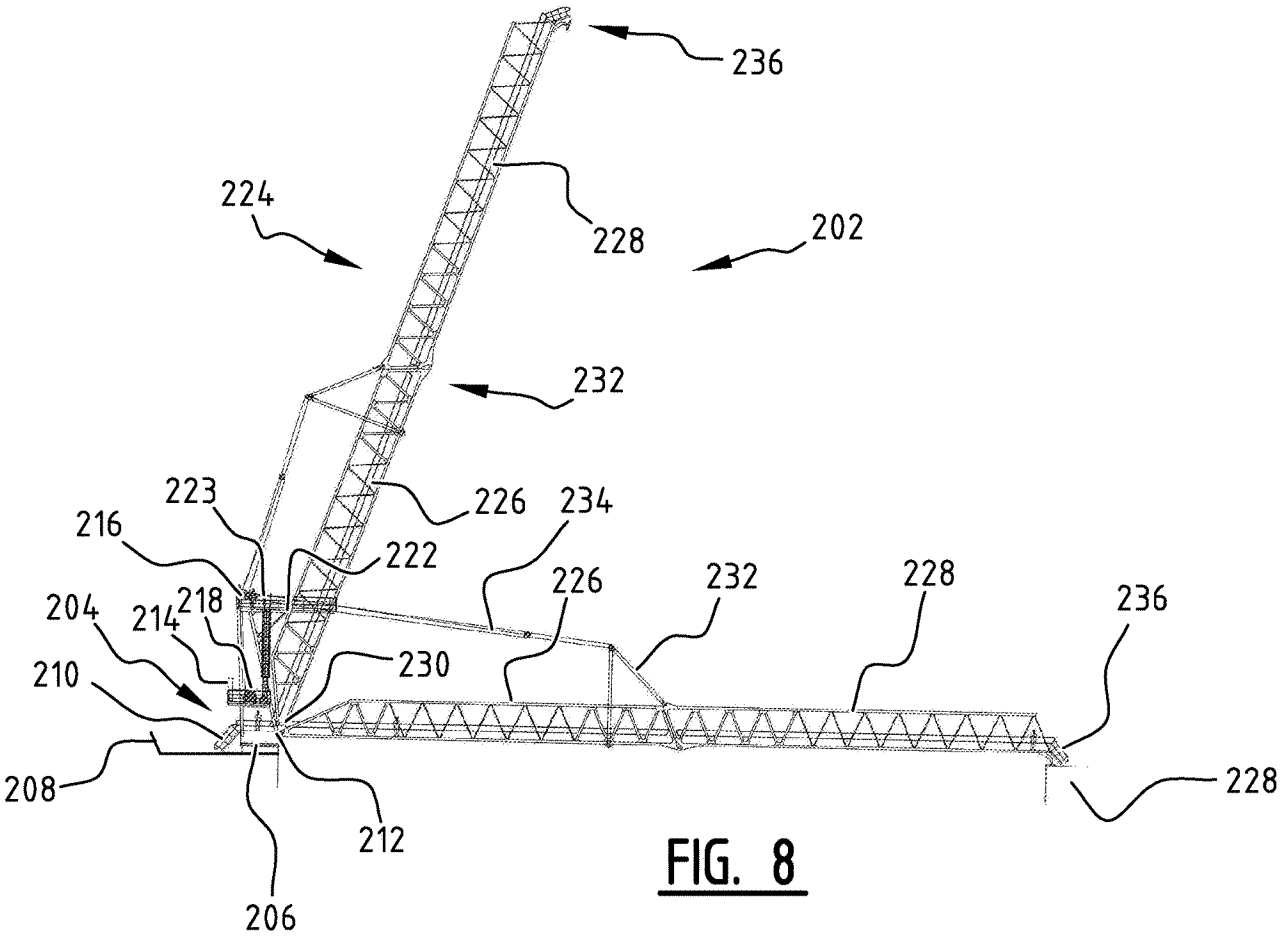

FIG. 7 A-B shows the bridge in a transport configuration;

FIG. 8 shows another foldable marine access bridge in two positions; and

FIG. 9 A-D shows the bridge of FIG. 7 when folding the bridge in different positions.

Figure 1:
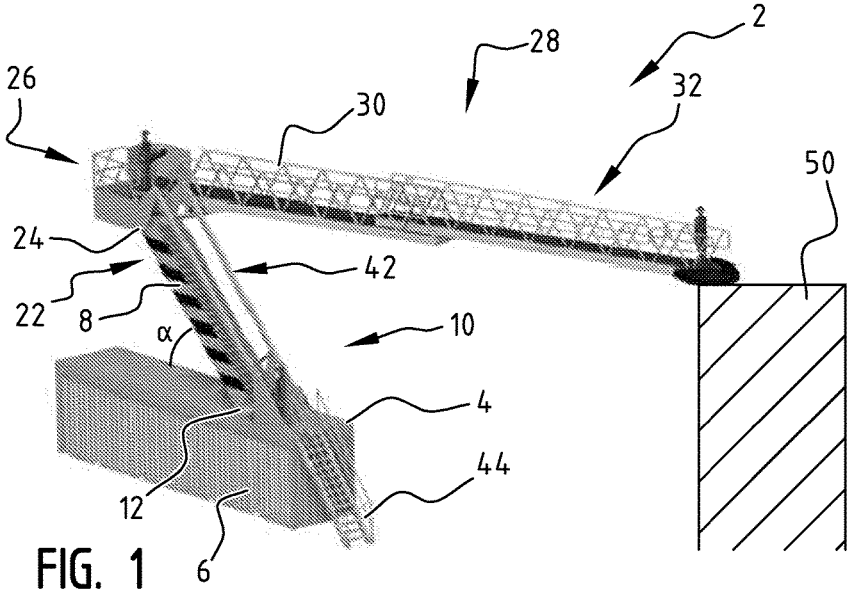
FIGS. 1 and 2 show a telescopic access bridge according to the invention in two positions.
Figure 2:
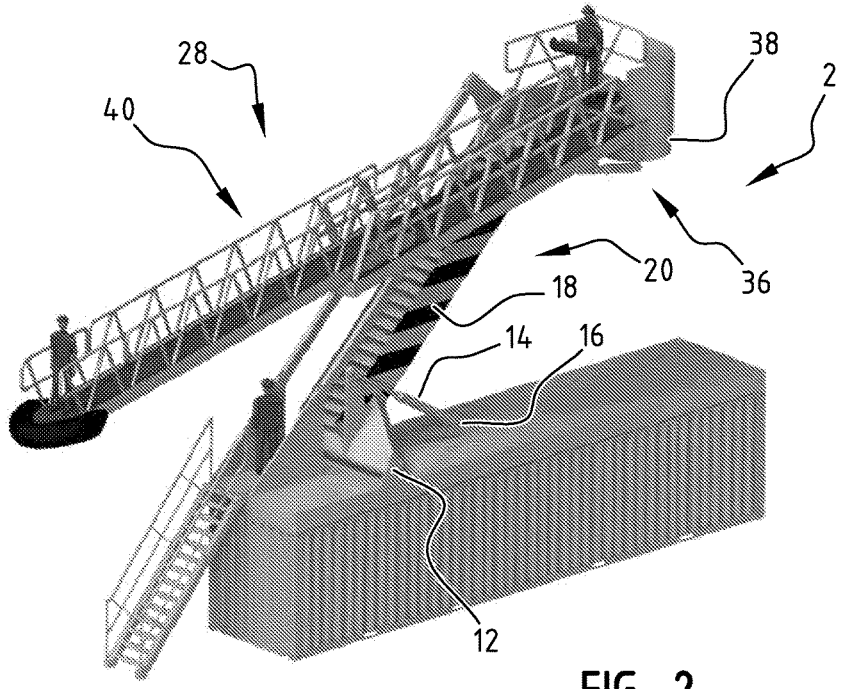

Telescopic access bridge 2 (FIGS. 1 and 2) comprises a base unit, in the illustrated embodiment flat rack 4 of container 6. Stairs 8 is connected with flat rack 4 at first end 10 with hinge or shaft 12. Height adjustment cylinder 14 acts as lifting mechanism and is connected with connection 16 to flat rack 4 and enables rotation of stairs around axis 12. Steps 18 of stairs 8 are mechanically adjustable with mechanism 20 to angle α of stairs 8 with flat rack 4. Other end 22 of stairs 8 is connected with hinge or shaft 24 to intermediate platform 26. Bridge 28 with main bridge 30 and telescopic bridge part 32 are connected at end 34 to platform 26. Luffing cylinder 36 enables a luffing movement. Slewing element 38 enables a slewing movement. Telescopic movement of bridge 28 is enabled by telescopic mechanism 40, for example including cylinders or a winch. Parallel beams 42 enable intermediate platform 26 and flat rack 4 to be level in all positions when manipulating adjustment cylinder 14. Stairs 44 enable access to bridge 2. Bridge tip 46 connects end 48 of bridge 2 to further unit 50. When positioning bridge 2, bridge 2 is moved in height with one or more cylinders 14. In this embodiment, in a transport mode bridge 28 is rotated relative to stairs 8 around vertical axis or shaft 46 to enable effective transport and/or storage. It will be understood that this storage position can optionally also be achieved with the (marine) container embodiment of bridge 2 shown in FIGS. 1-2.

Telescopic access bridge 102 (FIG. 3) is provided on ship 104. Bridge 102 connects ship 104 to unit 106 enabling easy and safe access from ship 104 to unit 106 and vice versa. Bridge 102 is situated on deck 108 of ship 102. 20 feet or 40 feet flatrack frame 110 is situated on 20 and/or 40 ft high cube container 112 (FIG. 4). In the illustrated embodiment frame 110 comprises platform 114 that can be reached from deck 108 with stairs 116. Platform 114 preferably comprises a modular hydraulic power unit for bridge 102. This enables stand alone operation of bridge 102. Elevating unit 118 further comprises stair 120. Stair 120 is connected to the top section of the elevating unit 118. Bridge 122 comprises main bridge part 124 and telescopic bridge part 126. Bridge parts 124, 126 can be telescopically moved relative to each other with telescopic drive system 128.

In the illustrated embodiment telescopic bridge part 126 (FIG. 3) comprises modular tip 130 enabling changing tip 130 for improving access to another type of unit 106. Tip 130 also comprises inflatable bumper 132.

Figure 3:
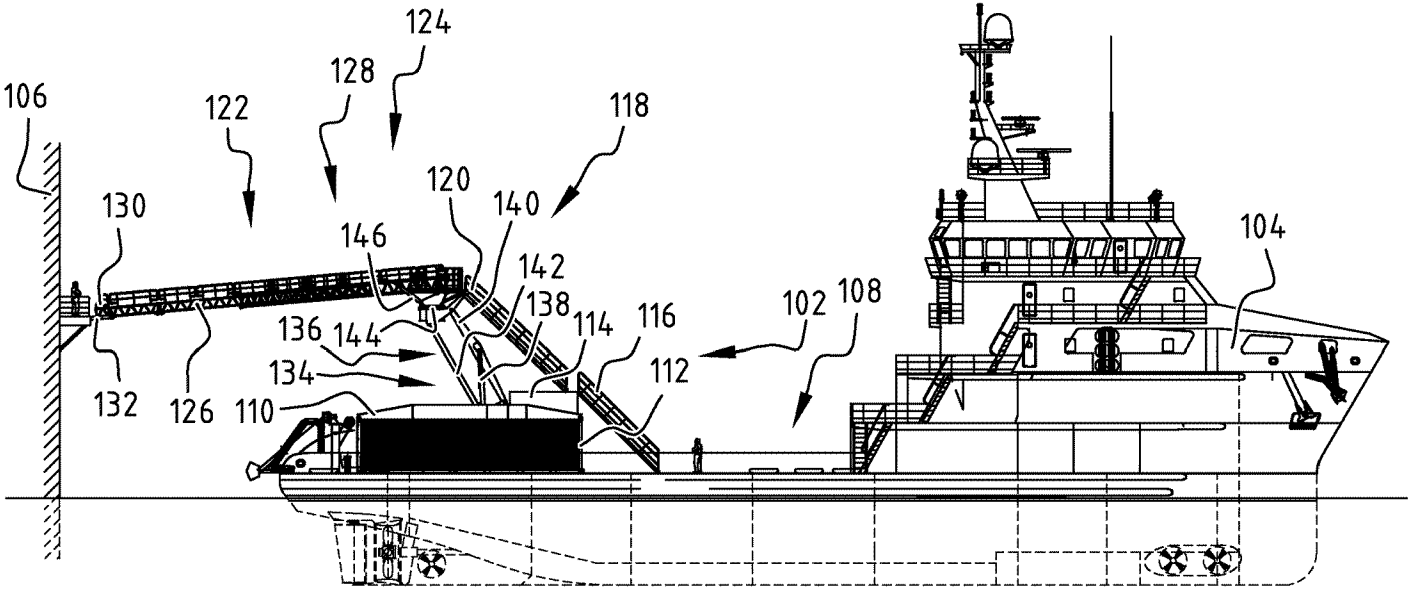
FIG. 3 shows a ship with an alternative bridge according to the present invention.
Figure 4:
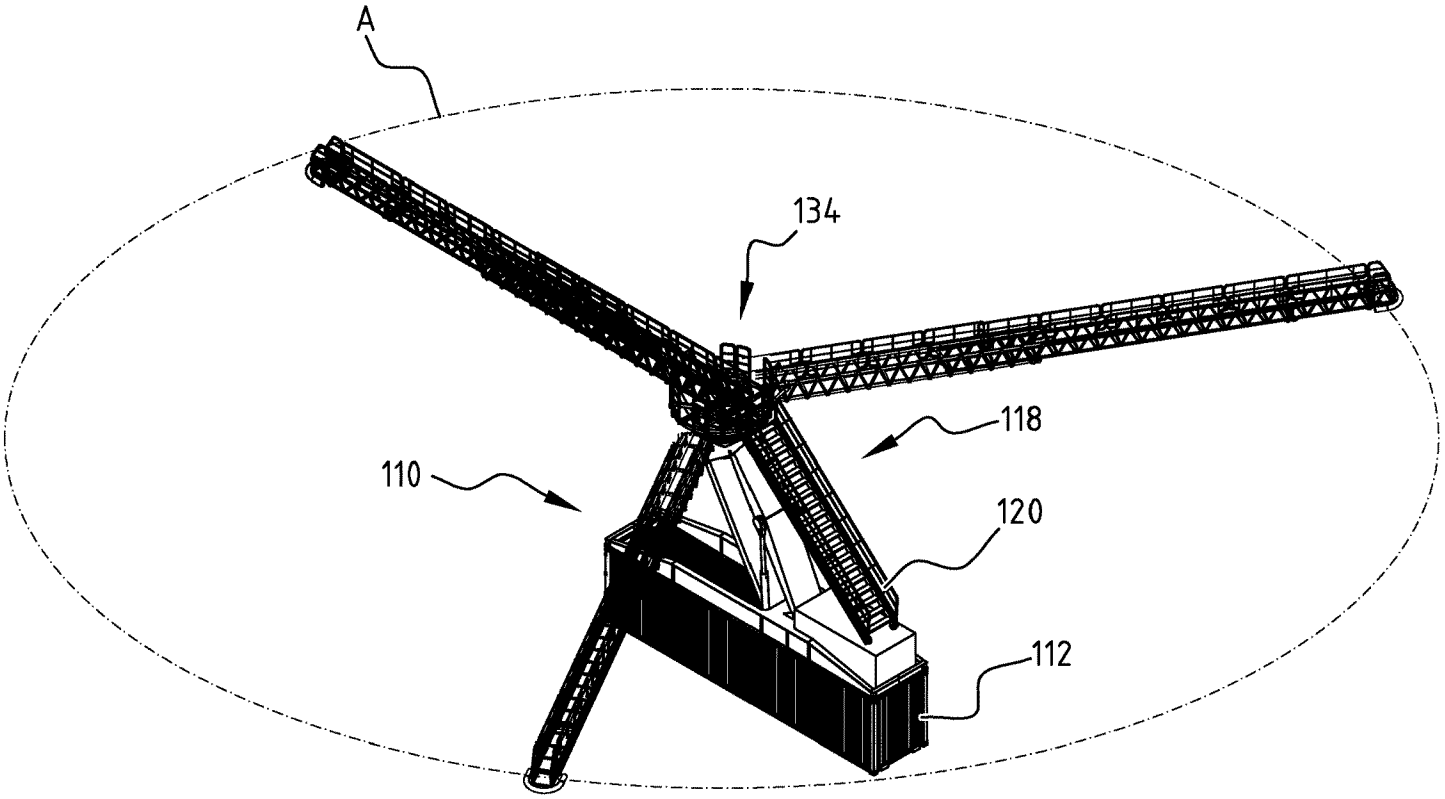
FIG. 4 shows the bridge of FIG. 3 in different orientations.
Figure 5:
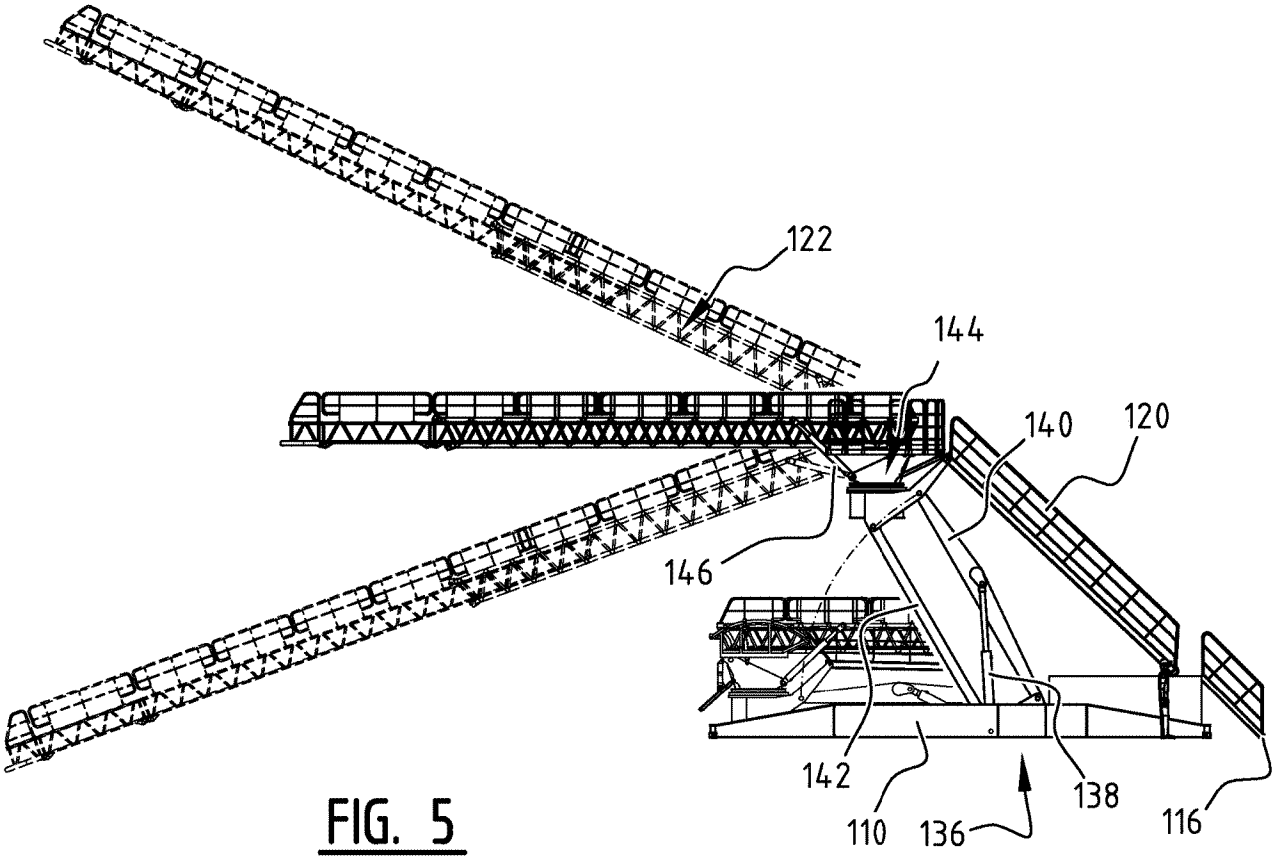
FIG. 5 shows the bridge of FIGS. 3 and 4 at different angles and lengths.

Intermediate platform 134 is provided between bridge 122 and stairs 120 (FIGS. 3-5). The bridge with platform 134 can be raised and/or lowered with lifting mechanism 136 comprising one or two hydraulic lifting cylinders 138 connected between frame 110 and connecting rod 140. Beam 142 stabilises the entire bridge and keeps it substantially horizontal.

Slewing mechanism 144 (FIGS. 3-5) enables operation in working area A (FIG. 4) in a substantial horizontal plane. Luffing cylinders 146 (FIGS. 3, 5) enable operation in a substantial vertical plane, preferably with a seamless adjustment. In the illustrated embodiment luffing cylinders 146 enable both positive and negative angles relative to a horizontal plane.

Figure 6:
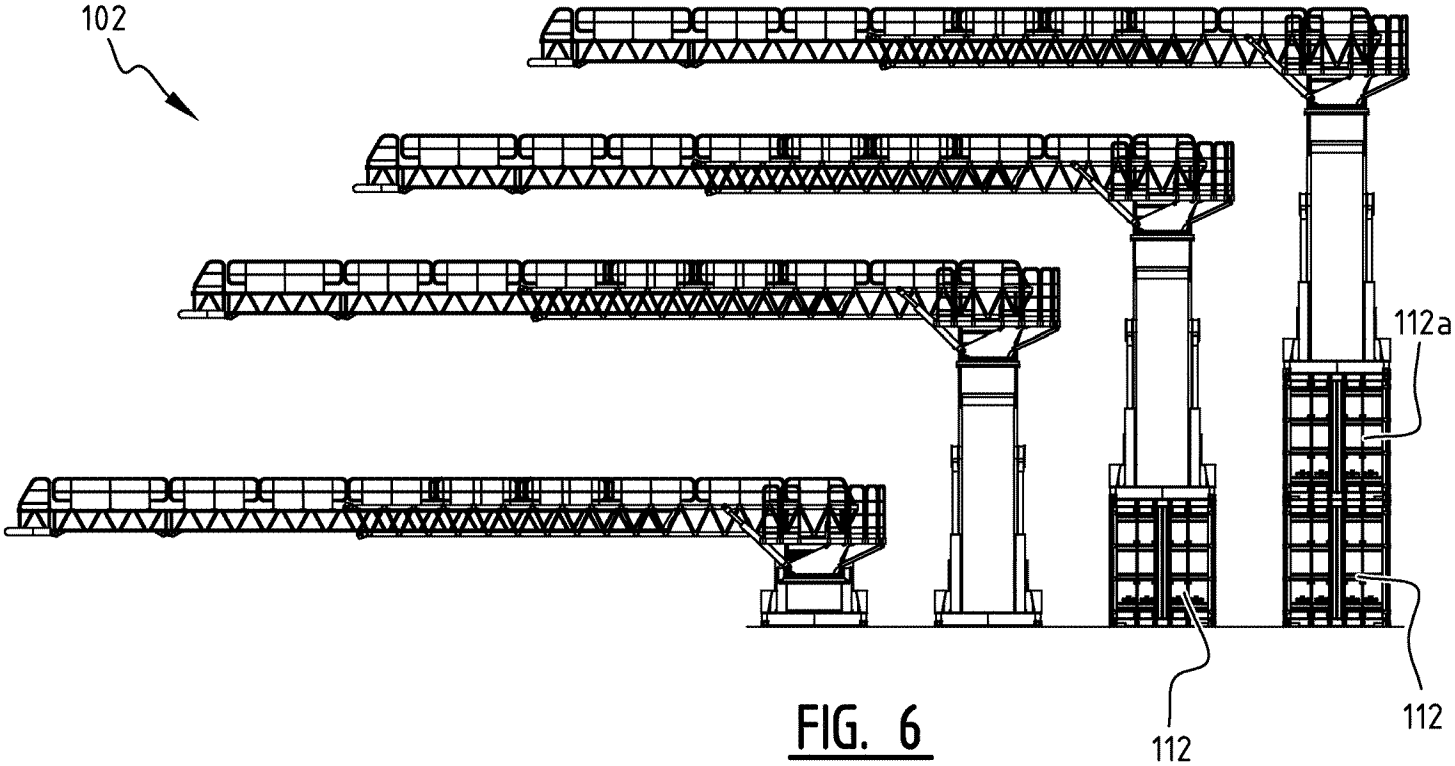
FIG. 6 shows the bridge of FIGS. 3-5 at different heights.

Bridge 102 (FIG. 6) can be adjusted in height with lifting mechanism 136. In addition, an additional container 112*a* can be provided to increase maximum height.

In a folded or storage position the illustrated bridge 102 is configured to fit 40 feet high cube container dimensions (FIG. 7 A-B). Bridge 102 can be transported with trailer 148.

When required, modular bridge 102 can be installed as a stand-alone unit on ship 104. When use is no longer required bridge 102 can be easily removed. When access to unit 106 is required lifting mechanism 136 raises intermediate platform 134 by extending cylinders 138. In the illustrated embodiment the joint operation of rod 140 and beams 142 stabilises platform 134. Telescopic bridge part 126 is moved relative to main bridge part 124 to extend bridge 122 and enable connecting to unit 106. To end the connection telescopic bridge part 126 is retracted and lifting mechanism 136 lowers bridge 102 to its rest position and/or storage position. In this position bridge 122 and elevating unit 118 extend substantially parallel to each other in a side-by-side or top-down orientation.

In another access bridge configuration, foldable marine access bridge 202 (FIG. 8) is connected to unit 204 with base frame 206 provided on vessel 208. Base frame 206 comprises entrance 210, platform 212, E-cabinet 214 for housing control components, and main platform 216. In the illustrated embodiment platform 212 houses main winch 218 and tugger winch 220. Main platform 216 houses main bridge locking system 222 and control stand 223.

Bridge 224 comprises main bridge part 226 and foldable bridge part 228. Main bridge part 226 is connected with main rotating shaft 230 to unit 204. Foldable bridge part 228 and main bridge part 226 are connected with folding mechanism 232. Bridge 224 further comprises two-wire receiving system 234 for storage of bridge 224. Folding bridge part 228 comprises tip support 236 connectable to fixed platform 238 in a use position (illustrated with the substantially horizontal orientation). It will be understood that in a position of use, bridge 224 can be provided at an angle to the horizontal depending on the relative positions of fixed platform 238 and unit 204. In the illustrated embodiment the length of bridge 202 in a position of use is about 70 m. It will be understood that other lengths would also be possible in accordance with the invention.

Figures 9A, 9B, 9C, 9D:
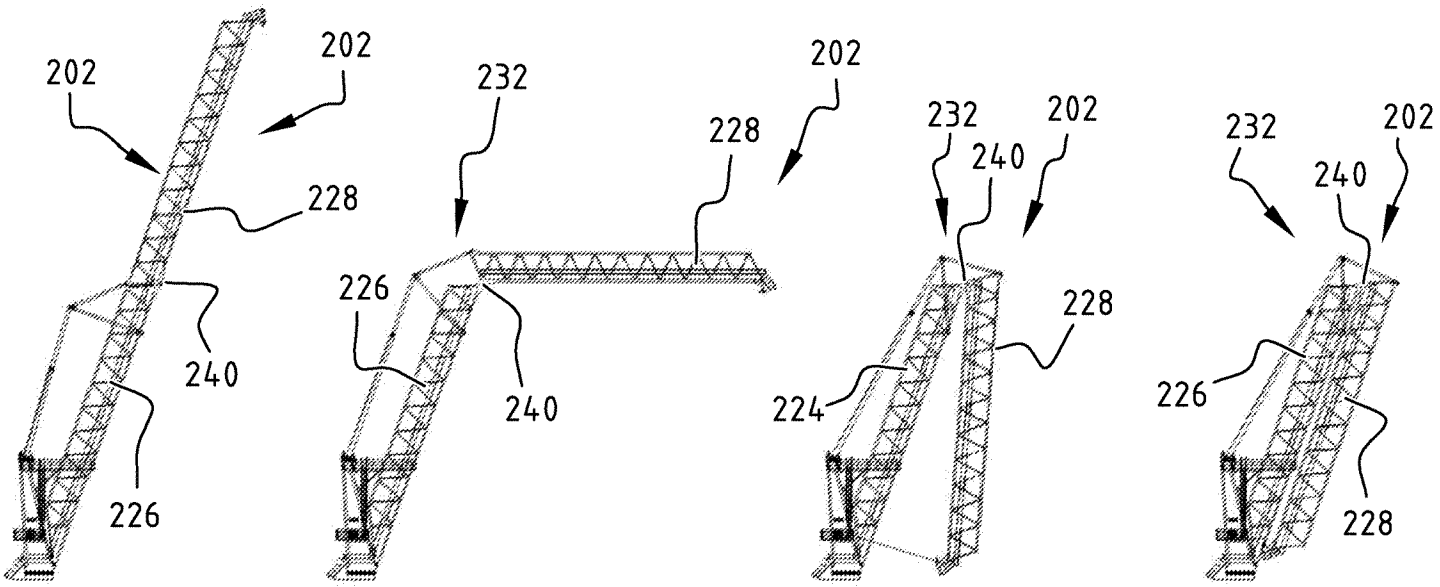

When folding bridge 202, locking system 122 is activated (FIG. 9A). Main winch 218 is activated. Foldable bridge part 228 rotates with folding mechanism 232 around connecting shaft 240 of folding mechanism 232 (FIG. 9B). From a substantial vertical direction (FIG. 9C) tugger winch 220 further rotates foldable bridge part 228 around connecting shaft 240 to main bridge part 226 (FIG. 9D) to bring bridge 204 in a storage position at an angle α relative to the vertical of about 5-15 degrees.

It will be understood that elements of the folding bridge 102 and 202 can be applied to telescopic access bridge 2, and vice versa. This may further increase the efficiency of providing access and regress to and from a unit.

The present invention is by no means limited to the above described preferred embodiments thereof. The rights sought are defined by the following claims within the scope of which many modifications can be envisaged.

The invention claimed is:

1. A telescopic access bridge, comprising:

a base unit;

an elevating unit having a first end with a first hinged connection to the base unit and a second end;

a bridge comprising a main bridge part and a telescopic bridge part, the bridge having one end with a second hinged connection to the second end of the elevating unit, and a compensating controller configured for providing an active and/or a passive compensation to the telescopic access bridge, wherein in the active compensation, the compensating controller is position controlled, and in the passive compensation, the compensating controller is force controlled;

wherein the second hinged connection is configured to enable a side-by-side orientation or top-down orientation of the elevating unit and the bridge in a storage position of the telescopic access bridge.

2. The telescopic access bridge according to claim 1, wherein the first and second hinged connections are configured to enable storing the access bridge in a folding position.

3. The telescopic access bridge according to claim 1, further comprising a slewing mechanism configured for rotating the bridge relative to the elevating unit.

4. The telescopic access bridge according to claim 1, further comprising a luffing mechanism enabling rotation of the bridge around a substantial horizontal axis.

5. The telescopic access bridge according to claim 1, wherein the elevating unit comprises a stair with a number of steps and further comprises a compensating mechanism configured for adjusting the angle of the steps with the angle of the stair.

6. The telescopic access bridge according to claim 1, wherein the unit is part of a ship, vessel or vehicle.

7. A vessel, ship or vehicle provided with a telescopic access bridge according to claim 1.

8. The telescopic access bridge according to claim 1, wherein the telescopic bridge part comprises a bridge tip configured for connecting to another unit in a position of use.

9. The telescopic access bridge according to claim 8, further comprising an inflatable bridge tip.

10. The telescopic access bridge according to claim 1, further comprising an intermediate platform connecting the elevating unit and the bridge.

11. The telescopic access bridge according to claim 10, further comprising a lifting mechanism configured for maintaining the intermediate platform substantially level, the lifting mechanism comprising a cylinder for raising and/or lowering the elevating unit.

12. The telescopic access bridge according to claim 11, the lifting mechanism further comprising one or more beams configured for maintaining the bridge substantially level.

13. A method for providing access, comprising:

providing a foldable telescopic access bridge according to claim 1; and positioning the bridge.

14. The method according to claim 13, further comprising storing the telescopic access bridge.

15. The method according to claim 13, further comprising actively and/or passively compensating movement of the base unit.

* * * * *